United States Patent [19]

Young

[11] Patent Number: 5,009,196

[45] Date of Patent: Apr. 23, 1991

[54] CAT RESTRAINER

[76] Inventor: Ruby Y. Young, P.O. Box 1094, Kerrville, Tex. 78029

[21] Appl. No.: 449,505

[22] Filed: Dec. 1, 1989

Related U.S. Application Data

[63] Continuation-in-part of Ser. No. 238,493, Aug. 31, 1988, abandoned.

[51] Int. Cl.[5] ..... A61D 3/00

[52] U.S. Cl. ..... 119/101; 119/96; 119/102

[58] Field of Search ..... 119/96, 101, 102, 103, 119/158; 128/869, 870

[56] References Cited

U.S. PATENT DOCUMENTS

| | | | |
|---|---|---|---|
| 68,427 | 9/1867 | Fenton | 119/103 |
| 502,054 | 7/1893 | Sirois | 119/102 |
| 833,119 | 10/1906 | Buckingham | 119/102 |
| 3,215,834 | 11/1965 | Tayman | 119/103 |
| 3,621,819 | 11/1971 | Hooper | 119/103 X |

FOREIGN PATENT DOCUMENTS

| | | |
|---|---|---|
| 219111 | 2/1985 | Fed. Rep. of Germany . |

*Primary Examiner*—Gene Mancene
*Assistant Examiner*—R. Thomas Price

[57] ABSTRACT

A combination of a harness and frame assembly (23) to provide a cat bathing, treating, breeding, transporting, and surgical restraint; wherein the harness apparatus (21) comprises supporting base member (10) having a restraining upper body (15) and lower body (17) harness member having a plurality of adjustment elements (7) and (19) and leg openings (14) connected to supporting base member (10); and, wherein the frame assembly comprises longitudinal side bar members (22) supported by leg members (6) attached to transverse bar members (24) by attachment elements (8); and wherein the harness and frame assembly (23) becomes a surgical device (20) comprised of a second set of leg members (9) that are adapted to be connected above the first set of leg members (6); a detachable center panel member (11) on its base member (16); a sheet of material (18) generally dimensioned to support the supine body of a cat or small animal attached to sides of longitudinal bar members (22) for securing over the back of the animal before inverting unit depending on whether a dorsoventral or ventrodorsal attitude is desired.

5 Claims, 2 Drawing Sheets

CAT RESTRAINER

This application is a continuation-in-part of Ser. No. 07/238,493 filed Aug. 31, 1988 now abandoned.

TECHNICAL FIELD

This invention relates generally to restraining apparatus and has particular reference to harnesses, slings, and frames to facilitate bathing, treating, breeding, transporting and surgical procedures on small four legged animals such as cats.

BACKGROUND OF THE INVENTION

As can be seen by reference to the following U.S. Pat. Nos. 4,796,565; 2,438,979; 3,215,834; 4,184,451; 163,378; and 152,276, the prior art is filled with myriad and diverse restraining harness apparatus for holding or immobilizing animals and children, and so forth.

While the aforementioned prior art construction are more than adequate for handling, holding and transporting the objects or items for which they were specifically developed, none of these devices are designed or intended to serve as a multipurpose restrainer, holder, carrier, breeder and surgical device for cats.

Despite the fact that at least one of the acknowledged prior art devices was developed to bathe dogs, or animals by means of a frame that must be adjusted and secured in a bath tub, and is harnessed in a plurality of straps, this type of harness would never hold a cat, given the supple nature of a cat's body and the ease with which they can escape from straps.

In another prior art device a holder for supporting cast animals is formed by a sling having aperture for the animals legs and udder. This device does not have a secure fitting combination sling and harness needed for fastening a cat, therefore not satisfactory.

In addition, none of the prior art constructions envisions the use of a suspended elevated base in combination with restraining means, wherein the restraining means provides a harness arrangement for cats which will serve the multiple function of holding the cat for the purpose of bathing, breeding, treating, transporting, and surgical procedures.

A problem which veterinarians have in performing surgical procedures on cats and small animals is the proper positioning of the animal after it has been anesthetized. It is most desirable that the animal be supported with the abdominal area in an upward position with the legs extended since most surgical procedures are performed best in this position. However, the structure of the body of a cat or dog is exactly contrary to this position, and there is no natural tendency for anesthetized animals to rest in a convenient surgical position, making it necessary for veterinary surgeons to require the aid of one or more assistants in maintaining the animal in the preferred position for surgery.

One of the acknowledged prior art devices provides an elongated, rigid base with opposed parallel ridges. It is suggested the base be made of plastic. This device could not be comfortable even for an anesthetized animal, therefore not satisfactory. It is therefore an object of the present invention to provide an improved structure for suppporting cats and other small anesthetized animals securely and comfortably for surgical procedures.

In an alternative embodiment the harness arrangement may be used to restrain and support a cat in either ventrodorsal or dorsoventral attitude within the confines of the apparatus.

More particularly, an object of this invention is to provide a comfortable, secure means of restraint by means of sling base on elevated frame to which harnesses are attached, including the provision of adjustable straps, all of heavy, washable fabric to receive and support the supine body of a cat or small animal in the most convenient position for the specific surgery being performed. A second fabric panel attaches to sides of frame and wraps around the back of the animal for added support.

Obviously there has existed a long felt need in this area of technology for an improved multipurpose cat harness apparatus that would address the aforementioned prior art shortcomings, and, the apparatus that forms the basis of the present invention was developed specifically to provide a solution to inherent deficiencies found in the prior art constructions.

SUMMARY OF THE INVENTION

The present invention comprises in general a multipurpose restrainer harness apparatus which though designed primarily to function as a cat bather can also be used as a carrier and breeder device. In addition this restraining bather unit secures pet firmly for surgical procedures at veterinarian's office or for medical treatment and grooming at home.

Briefly stated the improved harness and frame apparatus unit comprises elongated rectangular frame assembly supported by leg members and having a base member, wherein the base member is provided with four leg openings onto which an upper and lower body harness member is attached. Furthermore in an alternate embodiment the base member can be provided with reinforced drain holes to allow bath water to drain. Each harness has a plurality of adjustable straps provided with buckles and a textured material providing a multiplicity of loops, this type of material commonly referred to by the trademark "Velcro" at the tip of each strap. The harnesses are designed with a fixedly secured fabric support member supported at the base of and between the interconnecting strap elements whereby the legs of the animal are secured to said base member firmly and is the distinct feature which provides absolute restraint of escape to cats and restricts their body movement rendering them powerless to injure their attending handler.

It should be noted that in a preferred mode of operation the harness apparatus of this invention may be deployed within its frame to both restrain and support a cat in a partially suspended relationship relative to the ground. This partial suspension is particularly useful when a breeder female cat has difficulty in standing to be bred, a common problem to catteries.

It should further be noted that in another mode of operation this harness apparatus is adapted to function as a unique carrier for transporting a cat from one location to another while cat is strapped in a partially suspended relationship relative to the ground.

In still another embodiment the straps of the harness are unfastened and laid flat on the bather unit to provide a hammock.

In another prefered mode of operation the unit can be converted into an abdominal surgical device by the use of a second set of legs attached above first set of legs whereby the unit may be inverted onto the upper set of legs after pet has been firmly secured within the upper and lower body harness. A center panel within the base panel member, which is the suspension of the pet when in upright position, can be opened or closed by means of a textured material called "Velcro" after unit is inverted depending on the surgical procedure being performed. A rectangular fabric panel is attached to the elongated side bars of the frame and over the back of the anesthetized animal by means of the textured material called "Velcro". This fabric panel is dimensioned and positioned for extra support to the supine body of a cat or small animal.

BRIEF DESCRIPTION OF THE DRAWINGS

These and other objects, advantages, and novel features of the invention will become apparent from the detailed description of the best mode for carrying out the preferred embodiment of this invention which follows; particularly when considered in conjunction with the accompanying drawings, wherein.

BEST MODE FOR CARRYING OUT THE INVENTION

Figure 1:
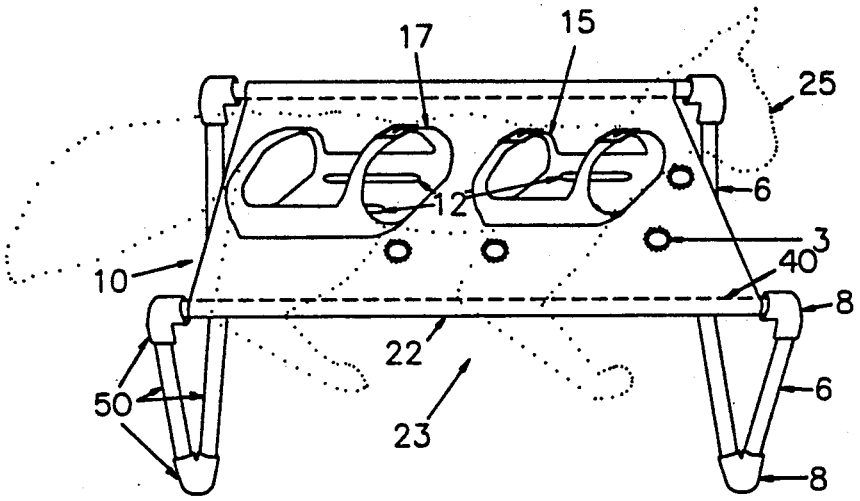
FIG. 1 is a perspective view of the cat bather/breeder restraint unit of this invention.
Figure 2:
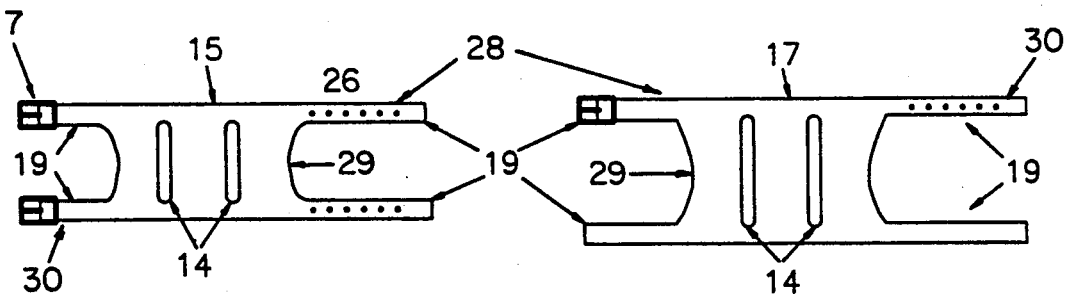
FIG. 2 is a top plan view of upper and lower body harness of the unit.

As can be seen by reference to the drawings and in particular FIG. 1, the harness and frame assembly unit that comprises the first major component of the present invention is designated generally by the reference numeral (23). The harness and frame unit (23) comprises in general: longitudinal bar members (22) transverse bar members (24) a plurality of elongated support members (6) a base member (10) with leg openings (12) and harness members (15) (17). The harness members (15) (17) are provided with a plurality of interconnecting strap elements (19) cooperating securing means (30) and leg openings (14) for holding, supporting and immobilizing in upright position a cat or small domestic animal. As can be seen by reference to FIG. 2, the harness member (28) comprises a generally rectangular body encircling element (29) which is dimensioned to support and at least partially encircle the underside of a cat's torso. The plurality of interconnecting strap elements (19) comprise at least two horizontally oriented and generally parallel strap members on each harness member (15) (17) as viewed in FIG. 2.

The cooperating securing means (30) comprise a well-recognized belt buckle arrangement wherein one end of the strap elements (19) is provided with a buckle member (7) and the other end of the strap element (19) is provided with a plurality of spaced holes (26).

It can be seen by reference to FIG. 1 that the body harness members (15) (17) and the base panel member (10) are secured to each other at the leg openings (14) and (12). The harness apparatus (28) in its operative disposition completely surrounds the cat's torso, wherein the body encircling element (29) is disposed beneath the pet and the horizontal strap members (19) complete the encirclement of the animal's torso.

The frame assembly of unit (23) and unit (20) is of a rectangular shape and is comprised of longitudinal bar members (22), transverse bar members (24) and a plurality of support members (6) of equal length. The ends of the plurality of support members (6) are detachably connected to the ends of the longitudinal bar members (22) and to the ends of the transverse bar members (24) at right angles.

It should be appreciated at this juncture that the frame assembly of unit (23) is provided with connecting means (8) whereby the unit may be easily disassembled for the removal and cleaning of the base member (10) if it becomes soiled.

In a preferred mode of operation the harness and frame unit is employed as a cat bather apparatus, wherein the base member can be provided with reinforced drain holes (3) for bath water to drain.

It should also be appreciated that in the aforementioned embodiment the harness and the frame assembly (23) can function as a carrier.

In a preferred embodiment of the invention depicted in FIG. 1, a female cat (25) is confined within the harness apparatus (21) and placed on a floor, or any flat level base such as a floor, to allow the male cat easy access to the female for breeding purposes. In this embodiment the harness and frame assembly unit (23) captively retains the cat (25) with her feet raised off the ground so that the unit (23) will not unduly move should the cat attempt to move.

Figure 3:
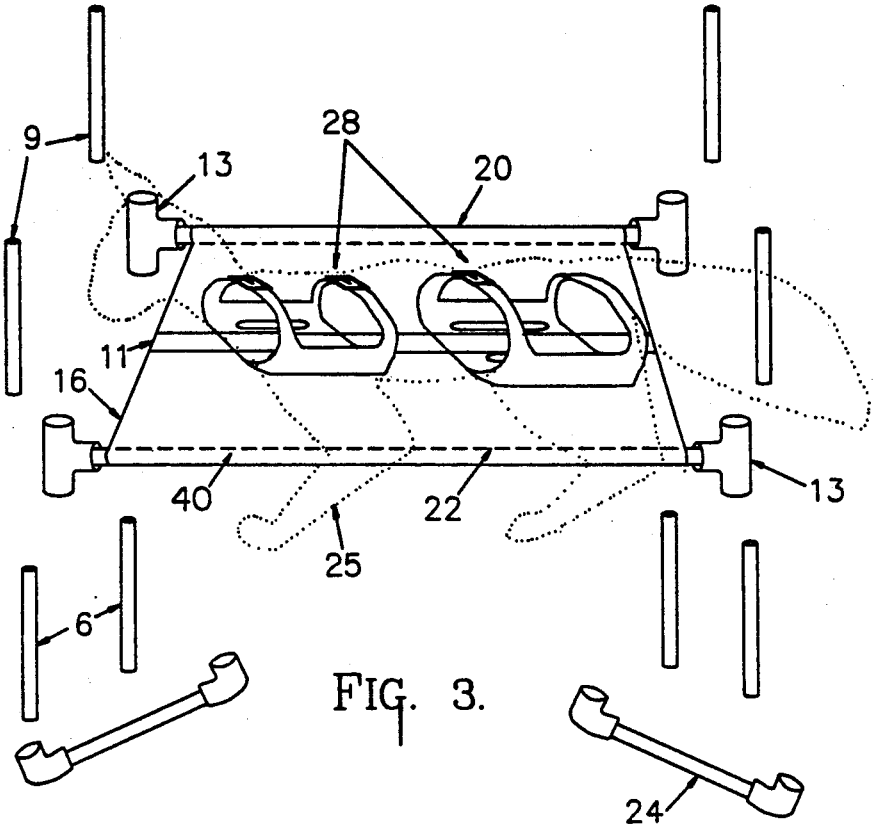
FIG. 3 is perspective view of the surgical harness and frame unit; of this invention.

As can best be seen by reference to FIG. 3, the surgical unit that comprises the second major component of this invention is designated generally by the reference numeral (20). The surgical unit (20) comprises in general a base member (16) a detachable center panel member (11) including a harness apparatus (28) comprised of: an upper (15) and lower (17) body harness member; a plurality of strap elements (19) provided with cooperating securing means (30) for holding, supporting and immobilizing in upright position a cat, which is indicated by phantom lines (25).

The embodiment of FIG. 3 is essentially the same as that illustrated and described with reference to FIG. 1 except that it includes an integral extension of leg members generally indicated by the numeral (9). The extension of leg members is contiguous with the elongated support members (6) of the basic unit (23) and are interconnected by joining means (13) to detachably secure these upper elongated support members (9) to opposing pairs of elongated support members (6).

It should be appreciated at this juncture that the second set of support members (9) are provided to hold the surgical harness and frame unit (20) in a suspended relation relative to the ground when unit is inverted to facilitate the performance of abdominal surgical procedures.

It can be seen that with the animal as positioned, surgery or X-rays may be completed by the veterinary surgeon without the help of an assistant. It can also be seen that the invention may be very effectively utilized to restrain a cat or other small domestic animal in both dorsoventral and ventrodorsal postural attitudes. The forms described herein are particularly useful for feline castration, urethrostomy, onychectomy, ovarianhysterectomy, ceasarian sect and so forth.

Both structures, the cat bather restraint (23) and the surgical unit (20), permit assistant free restraint for radiography and surgical procedures. In all modes of deployment the harness apparatus (28) will maintain a basic operative relationship relative to the users'pet (25).

In this invention the base (10) and (16) can be composed of a durable and flexible material such as canvas in sheet form, and as shown in the drawings of FIG. 1 and 3, the longitudinal edge portions of both bases (10) and (16) are attached to longitudinal bar members (22) by means of casings (40) formed along longitudinal edges of the bases (10) and (16) and arranged to accommodate therein the longitudinal bar members (22) of the units (20) and (23).

Figure 4:
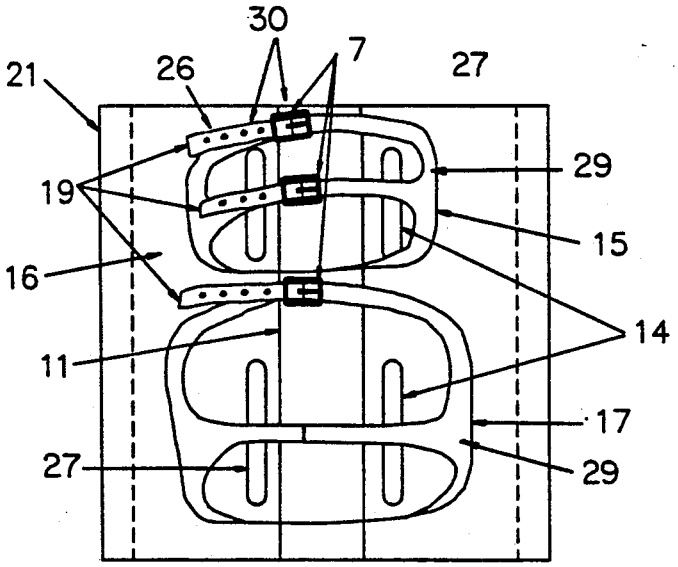
FIG. 4 is a top plan view of base and harness assembly of the surgical unit of this invention.
Figure 5:
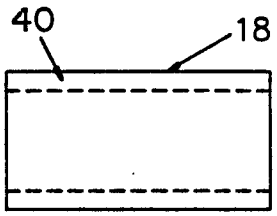
FIG. 5 is top plan view of back wrap panel of the surgical unit.

As can be seen by reference to FIG. 4, the restraining member that comprises a major component of the surgical unit (20) is designated by the reference numeral (21). The restraining member (21) comprises in general the second base member (16) provided with leg openings (27) detachable center base panel member (11) and body harness member (28), a plurality of interconnecting strap elements (19) provided with cooperating securing means (30).

The body harness member (28) comprises a generally rectangular body encircling element (29) which is dimensioned to support and at least partially encircle the underside of a cat's torso. The plurality of interconnecting strap elements (19) comprise at least two horizontally oriented and generally parallel strap members (19) on each harness (15) (17) as viewed in FIG. 2.

The cooperating securing means (30) comprise a well-recognized belt buckle arrangement wherein one end of the strap elements (19) is provided with a buckle member (7) and the other end of the strap element (19) is provided with a plurality of spaced holes (26).

The base member (16) is of a generally rectangular shape and is provided with means to detachably secure the rectangular center base panel member (11) approximately the length of the base (16) and between the leg openings (14) of the upper body (15) and lower body (17) harnesses by use of a commercially available product sold under the trademark "Velcro", the trademark being owned by Velcro Corp., New York, N.Y., using a strip placed on each longitudinal under side of center base panel member (11) and each longitudinal upper side of the base panel member (16).

Velcro is a material providing both a multiplicity of small loops and resilient hooks. When the loops are pressed against the hooks they are received and thereby held in position, and, with enough pressure, the flexible hooks are disengaged from the loops. By the foregoing arrangement the opening of the base center panel member (11) can be adjusted to a desired size depending on the abdominal surgical procedure being performed.

The leg openings (27) of the base (16) and the leg openings (14) of the harnesses (15) (17) are designed to completely surround a pet's legs even when the center base panel member (11) is opened and provides support to the animal's legs in a resting position while pet is held with the stomach and chest portions of the body upwardly exposed where most surgical operations are performed.

It can be seen by referring to FIG. 4 that the body harness members (15) (17) and the base panel member (16) are secured to each other at the leg openings (14) (27).

In the latter embodiment depicted in FIG. 3 a panel in the form of a sheet of material (18) about the size of the base (16) is provided with an adhesive material known as "Velcro" on the longitudinal edge portions and is placed over the back of a cat or small domestic animal while strapped in an upright position in the unit (20) and secured to the longitudinal sides (22) of the unit (20) for added support before the unit (20) is inverted to facilitate abdominal surgical procedures.

It should be appreciated at this juncture that the frame assembly of unit (20) is provided with detachable connecting means (13) whereby the unit (20) may be easily disassembled for the removal and washing of the base (16) and back wrap sheet of material (18) if it becomes soiled with blood as a result of the operating procedures.

It can be seen that the invention may be very effectively utilized to restrain cats or other small domestic animals in both dorsoventral and ventrodorsal postural attitudes. These positions are particularly useful for feline castration, ovarianhysterectomy, ceasarian sect, urethrostomy, onychectomy and so forth. Both structures, the bather and the surgical apparatus, permit assistant free restraint for radiography and surgical procedures.

My harness on its base and frame conveniently and securely holds a cat for bathing, treating, grooming, breeding, and carrying purposes without causing any undesirable inconvenience to the animal or injuries to its handler, and also prevents the cat from shaking itself until it is thoroughly towelled dry after the bath.

While the invention has been described with a certain degree of particularity, it is manifest that many changes may be made in the details of constuction of the invention without departing from the spirit and scope hereof. It is understood that the invention is not limited to the embodiments set forth herein for purposes of exemplification, but is to be limited only by the scope of the attached claim or claims, including the full range of equivalency to which each element thereof is entitled.

What is claimed as new and desired to be secured by Letters Patent is:

1. A cat restraining apparatus comprising the combination of a harness apparatus and frame assembly for securing and supporting cats and other small domestic four legged pets for bathing, treating, breeding, transporting and surgical procedures, wherein the combination comprises:

a harness apparatus unit including a base member having four leg openings and supported horizontally on the frame assembly and, wherein the base member is composed of a durable, and flexible sheet of material with its longitudinal edge portions attached to longitudinal members of the frame assembly;

the harness apparatus wherein said base member is generally rectangular and of sufficient size to accommodate four leg openings for a cat or other small animal;

the harness apparatus wherein an upper and lower body harness member is fixedly secured to said base member and further includes a pair of openings that receive the legs of an animal;

the harness apparatus wherein said upper and lower body harness member has a lower body encircling element and has a fixedly secured fabric support panel member provided at the base of and between a plurality of interconnecting strap elements;

said upper and lower body harness member wherein said plurality of interconnecting strap elements are provided with cooperating securing means adapted to captively surround the torso of a cat;

a frame assembly associated with said harness apparatus including upper longitudinal side members approximately the length of said base member, lower transverse members approximately the width of said base member, and a plurality of elongated support members: of equal length;

the plurality of elongated support members of equal length and means to detachably connect said elongated support members to said longitudinal side members and to said transverse members normally, or at right angles.

2. A cat restraining apparatus comprising the combination of a harness apparatus and frame assembly for securing and supporting cats and other small domestic four legged animals for bathing, treating, breeding, transporting, and surgical procedures, wherein the combination comprises:

a harness apparatus unit including a base member and a harness member;

the harness apparatus wherein the base member is a generally rectangular sheet of material of sufficient size to accommodate four leg openings for a cat or other small animal and supported horizontally on the frame assembly;

the harness apparatus wherein the longitudinal edge portions of said base member are attached to said longitudinal members of said frame assembly by means of casings formed along longitudinal edge portions of said base member and arranged to accommodate therein said longitudinal members of said frame assembly;

the harness apparatus associated with said base member wherein said harness apparatus includes an upper and lower body harness member and each harness member having a plurality of interconnecting strap elements provided with cooperating securing means wherein said upper and lower harness captively surrounds the torso of a cat; and, the improvement wherein said upper and lower body harness member is fixedly secured to said base member;

the harness apparatus unit including an optional alternate base member provided with reinforced drain holes to allow bath water to drain;

a frame assembly including elevated longitudinal said members of equal length, transverse members of equal width and a plurality of elongated support members of equal length;

means for joining the elongated support members to each end of said longitudinal side members and each end of said transverse members normally, or at right angles.

3. A cat restraining apparatus as in claim 2 wherein said plurality of elongated support members of equal length are joined to opposed pairs of elongated support members by attachment elements forming an integral extension of and contiguous with the elongated support members, whereby the harness apparatus and frame assembly unit may be supported by the opposed pairs of elongated support members when inverted for abdominal operations.

4. A cat restraining apparatus as in claim 3 wherein said harness apparatus is further provided with a back supporting panel composed of a durable and flexible material in sheet form generally dimensioned to support the back of the supine body of a cat or small animal, with its longitudinal edge portions provided with a strip of fabric providing a plurality of loops of filaments and wherein the supporting panel is removably secured to longitudinal side members of said frame assembly by means of a strip of material having an upper surface formed of upstanding filaments each configured as a hook at the upper end.

5. A cat restraining apparatus as in claim 2 and 3 wherein said base member is provided with a detachable longitudinally dimensioned center panel member between the leg openings of said base member and, wherein an underside surface of both of said longitudinal edge portions of said center panel member are provided with a strip of fabric providing a plurality of loops of filaments, and wherein the surface of both upper longitudinal sides of said base member are provided with a strip of material having an upper surface formed of upstanding filaments each configured as a hook at an upper end whereby said center panel member is removably secured to said base member, and, whereby the size of an opening on the said base member can be adjusted to expose the abdomen of a pet.

* * * * *

UNITED STATES PATENT AND TRADEMARK OFFICE

CERTIFICATE OF CORRECTION

PATENT NO. : 5,009,196

DATED : April 23, 1991

INVENTOR(S) : Ruby Y. Young

It is certified that error appears in the above-identified patent and that said Letters Patent is hereby corrected as shown below:

Col. 1, line 20, change "construction" to - "constructions".

Col. 2, line 42, change "supported" to - "Provided".

Signed and Sealed this

Fifteenth Day of September, 1992

*Attest:*

*Attesting Officer*

DOUGLAS B. COMER

*Acting Commissioner of Patents and Trademarks*